United States Patent [19]

Grubb

[11] 4,115,049

[45] Sep. 19, 1978

[54] MEANS FOR FORMING AND SPLITTING PRESTRESSED CONCRETE ELEMENTS

[76] Inventor: Donald G. Grubb, 7129 17th Ave. South, Minneapolis, Minn. 55423

[21] Appl. No.: 802,777

[22] Filed: Jun. 2, 1977

[51] Int. Cl.[2] ..... B28B 23/04

[52] U.S. Cl. ..... 425/111; 249/52; 249/121

[58] Field of Search ..... 264/228, 229; 425/111; 249/94, 97, 52, 121

[56] References Cited

U.S. PATENT DOCUMENTS

| | | | |
|---|---|---|---|
| 449,884 | 4/1891 | Moore | 249/121 |
| 2,924,962 | 2/1960 | Nettle | 249/13 |
| 3,999,913 | 12/1976 | Branitzky | 425/111 |
| 4,023,767 | 5/1977 | Fontana | 249/52 |

*Primary Examiner*—Francis S. Husar
*Assistant Examiner*—John McQuade
*Attorney, Agent, or Firm*—Douglas L. Carlsen

[57] ABSTRACT

A form for molding building wall panels of a concrete material, wherein the form has a rectangular shallow box shape for receiving and enclosing the material while it hardens, the form having a plurality of elongated inserts extending broadwise therethrough in parallelism and on a horizontal plane to form a break line in the panel, and prestressed tension rods or post tensioned cable means extending through the form to be embedded in the material at at least one side of the break line to cause the panel to split along the break line when the rods are removed after the material has hardened.

2 Claims, 5 Drawing Figures

MEANS FOR FORMING AND SPLITTING PRESTRESSED CONCRETE ELEMENTS

BACKGROUND OF THE INVENTION

Many structural members are formed of precast structural concrete including building wall panels. Such panels may vary in weight from a few pounds to several tons and may be precast in a mechanized central plant or by somewhat cruder methods right on the building site. Regardless of where the precasting takes place, it is important that the process permit production controls and the use of high quality concretes and that repeated use of forms be permitted.

In wall panel applications the concrete frequently serves not only as a load bearer but in an ornamental or aesthetic sense. In such use the panel is generally reinforced by steel bars embedded in the concrete, with the tensile strength of the steel supplementing the compressive strength of the concrete.

One manner of reinforcing concrete is by placing it in a state of permanent compression through prestressing. A method of prestressing or pretensioning concrete panels or slabs is to stretch steel bars or the like between two abutments in a form before the concrete is placed. After the concrete has hardened around the tensioned bars the stretching forces are released as by cutting the ends of the bar and, as the steel seeks to regain its original length, the tensile strength in the steel is translated into compressive stress in the concrete by the bond between the steel and concrete.

Another method of reinforcing concrete is accomplished through a post tensioning process. Here steel cables or wires are located in ducts embedded in the concrete. After the concrete has hardened the steel is stretched by hydraulic rams and fastened by wedges or other gripping devices. In this process the steel is tensioned against the concrete so that the tension exerted on the steel corresponds to an equal compression on the concrete.

There are three principal steps in the manufacture of a concrete masonry unit. These are (1) the proper mixing of the cement, water and aggregates, (2) the molding of the units, and (3) the curing or drying. Generally the molding is by tamping the concrete into the molds or by vibrating or pressure.

It is desirable that building blocks or tiles be provided with an exterior surface having ornamental characteristics which are formed at the time of casting of the block. The present invention is directed generally to a form construction for casting building wall panels or blocks of cementitious material which provide for simultaneous casting of two such panels and means for separating such panels after the material is set and prior to removal from the form.

The prior art discloses the forming of building blocks or tiles with frangible interior wall portions which may be severed to divide the block into two or more sections each of which may be used for a different purpose or to present a different appearance in a building wall. As exemplary of the disclosure of such blocks and in some cases the molds or forms therefor are U.S. Pat. Nos. 2,560,731 to Miller; 1,501,709 to Grueby; 1,534,353 to Besser; 787,199 to Lloyd; and 1,980,270 to Harkort.

While these patents show blocks which are severed in some way after molding the severing or splitting is generally accomplished by some mechanical wedging means or the like which requires considerable skill and which can result in loss of the block when the splitting is imperfectly performed. In the present invention the possibility of human error is reduced considerably by providing a weakening plane in the block during the molding or casting thereof and then applying contraction or tension pressures to the block on opposite sides of the weakening plane to cause the block to split along said plane. A block so formed with a weakening plane could, of course, also be split mechanically with or without vibration.

Preferably the weakening plane is formed by a series of elongated tubes or inserts positioned in spaced parallel, side by side relation along the plane and adapted to give a desirable ornamental surface on both sections split on the plane to serve as ornamental interior or exterior surfaces for a building wall.

SUMMARY OF THE INVENTION

A primary object of this invention is to provide a form for molding building wall panels of concrete or cementitious material or the like which may be used with equal effectiveness on or off of the building site and wherein a molded concrete body may be split into two or more panels while still in the mold.

Another object of the invention is to provide a concrete building block mold wherein wall panels are prestressed or post tensioned for planar compression of the panel to add strength thereto and wherein the panels formed from a common block may be stressed in both directions.

Still another object of the invention is to provide a form for manufacturing building wall panels which permits formation of various exterior ornamental surfaces on the panel and the use of various aggregates in the same.

With these and other objects in view the invention broadly comprises a form having a relatively broad flat box-like configuration with inserts extending broadwise through the form on a common plane to form a weakend plane in a concrete mass placed into the form, and prestressed or post tensioning means extending through the form on opposite sides of the said common plane but generally parallel thereto which when activated will cause a block molded from said mass poured and cured in the form to split along the weakened plane into two wall panels.

DESCRIPTION OF THE PREFERRED EMBODIMENT

Figure 2:
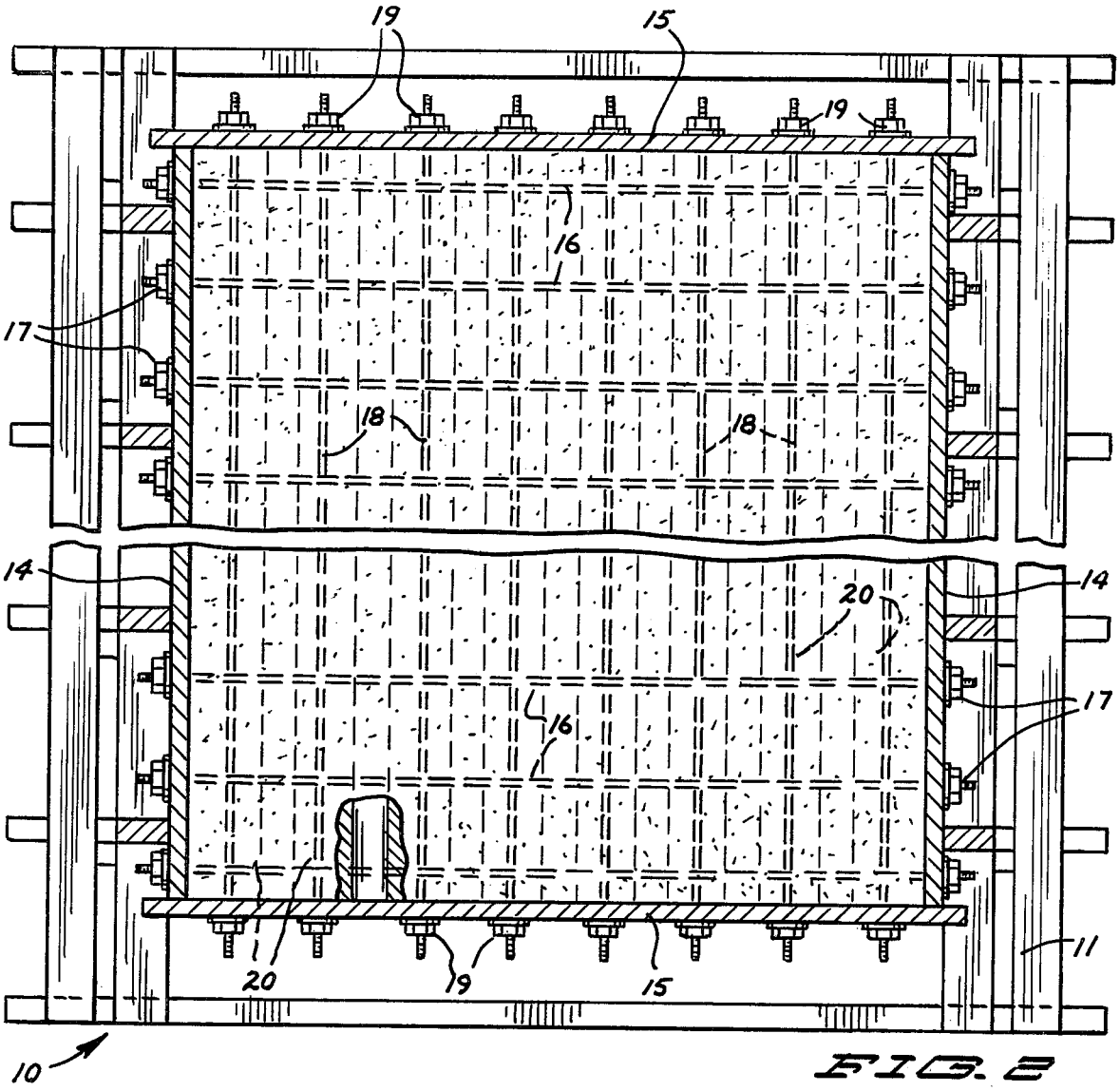
FIG. 2 is a horizontal section through the form taken on line 2—2 of FIG. 1 and looking downwardly.

Referring now more particularly to the drawings reference characters will be used to denote like parts and structural features in the different views. A form for molding the concrete is denoted generally at 10 and has a supporting base 11 adapted to have broad contact with a floor, ground or other horizontal surface S. The form may be provided with an undercarriage having wheels, skids or other means for movability.

Figure 1:
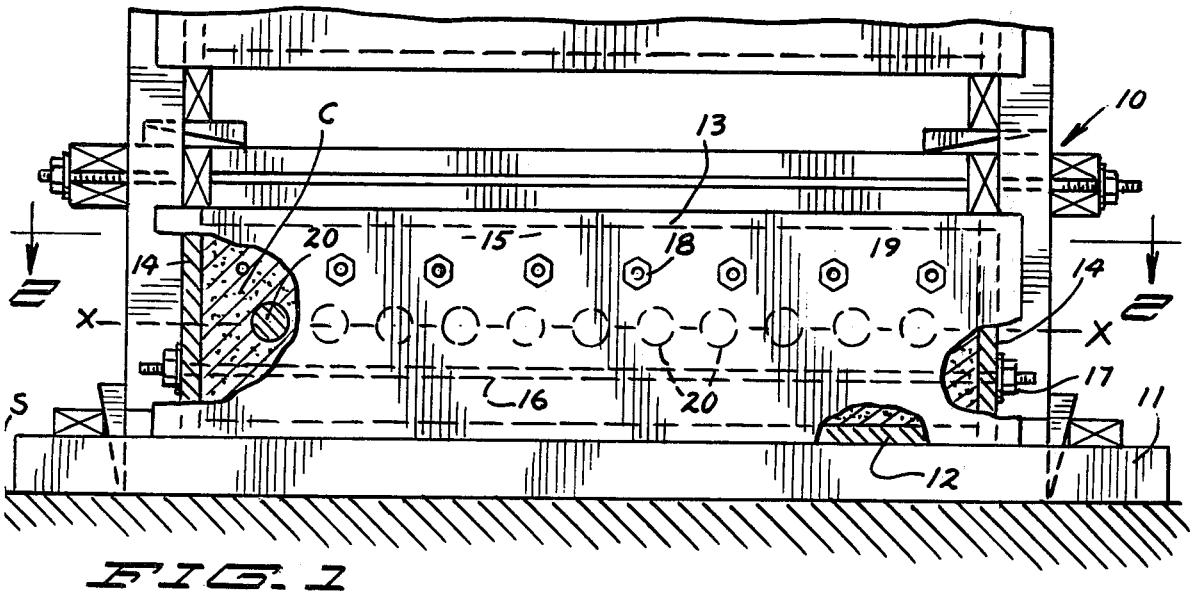
FIG. 1 is an end elevation of the form with portions of the end wall of the form broken away to show relative positions of the prestressed rods and the insert members forming the weakened plane.
Figure 3:
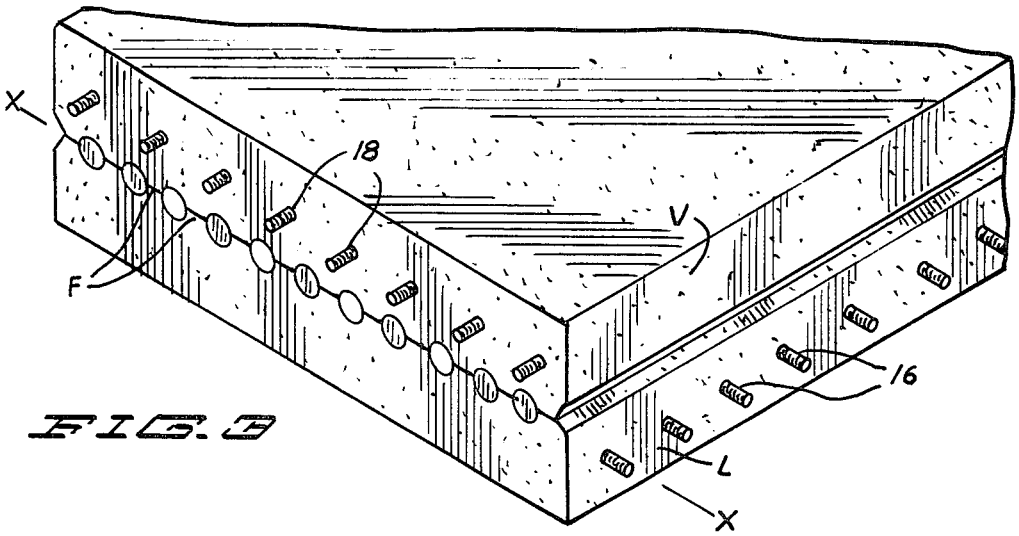
FIG. 3 is a perspective view of a hardened concrete mass after the form has been removed.

Form 10 has a broad, shallow horizontally rectangular box-like configuration. It includes a bottom wall 12, top wall 13, parallel side walls 14 extending longitudinally of the form and end walls 15. Top form 12 may form the bottom wall for another form stacked above form 10. These walls are reinforced by various other frame members shown so as to withstand substantial tensile stress between opposing wall members. A plurality of rods 16 are positioned to extend in parallelism crosswise in the form between the side walls 14. These rods 16 lie on a common plane medially between the bottom wall 12 and the central medial horizontal plane of the form indicated by the line *x—x* in FIGS. 1 and 3. Rods 16 are prestressed and held under tension between the walls 14 by means of washer and nut assemblies 17.

A plurality of rods 18 are positioned to extend in parallelism lengthwise of the form 10 between the end walls 15. These rods lie on a common plane medially between the top wall 13 and the central medial horizontal plane of the form. Rods 18 extend in a perpendicular direction to the rods 16 and are prestressed and are held under tension between the end walls 15 by the nut and washer assemblies 19.

The numerals 20 denote a plurality of inserts which extend parallel to rods 18 and are aligned in parallelism on a plane along the line *x—x* which extends through the vertical center of the mold medially between the plane of rods 18 and the plane of rods 16. These inserts may be of tubular metal or wood or any other material and serve the purpose of providing voids in the concrete material poured into the mold to weaken the plane through a block formed therein along the line *x—x*.

When the rods 16 and 18 have been secured under tension within the form 10 and the inserts 20 have been suitably positioned as shown, the concrete material C is poured or pumped into the form to fill the same around the rods 16 and 18 and inserts 20. Vibration may be applied to settle the concrete in the form. The top wall 13 of the form is inserted in the form. Several of these forms may be used in stacked relation as suggested in FIG. 1.

It will be understood that the stress on rods 16 and 18 act in different directions. After the concrete C in the form 10 has set or hardened into a block the tension is relieved from these rods as by removing the assemblies 17 and 19. As this occurs the tension on rods 16 is transmitted to a contracting force in the block in a transverse direction below the plane *x—x* while the tension in rods 18 will be transmitted to a contracting force in the block in a longitudinal direction above the plane *x—x*. These contracting pressures acting normal or perpendicular to each other above and below the plane *x—x* will cause the concrete body or block C to fracture along the plane *x—x* as denoted by the letter F in FIG. 3 into upper V and lower L panels.

In lieu of prestressed rods 16 and 18, the form may be provided with means for forming passageways in the block. Cables extending through these passageways are then tensioned after the concrete has set to cause the fracture of the concrete block in the same manner as the prestressed rods.

Figure 4:
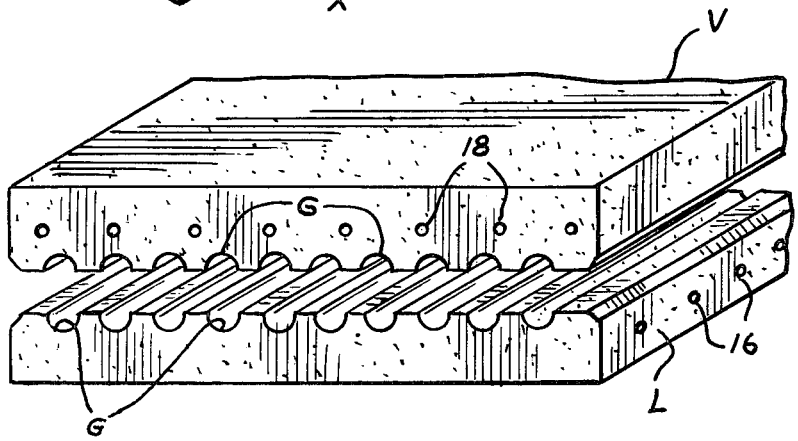
FIG. 4 is an exploded view of two wall panels made in the same form with the inserts forming the weakened plane removed.
Figure 5:
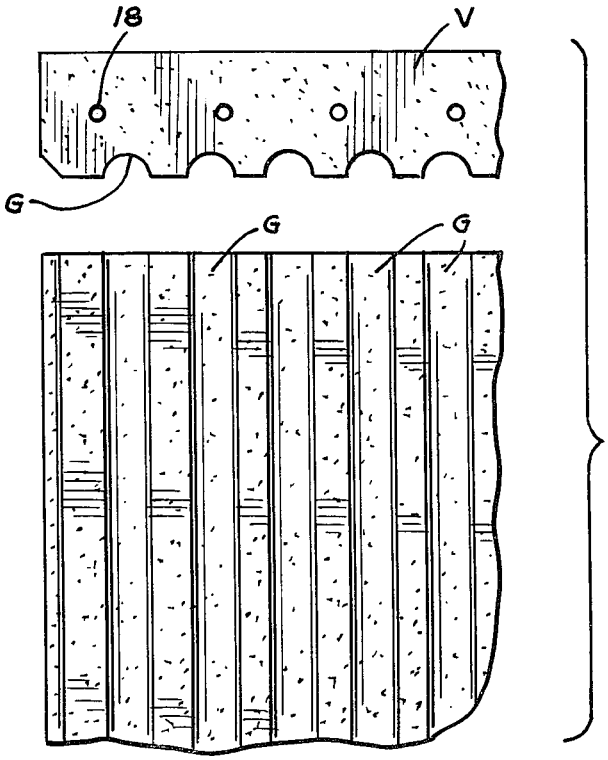
FIG. 5 shows end and plan views of a portion of a wall panel made in the form.

When the block has been split, the form 10 is removed therefrom. The upper V and lower L panels are then vertically separated (FIG. 4) and the inserts 20 are removed. After removal of the inserts the inner face F of each panel V and L is left with a plurality of grooves G which create a decorative appearance in the panel face. These grooves supplement the remainder of the panel face wherein the face portions between the grooves G have an irregular or random surface caused by the splitting of the block along the weakened plane.

While the inserts 20 are an important part of this invention to form the desired weakened plane, it will be understood that they may have various cross-sectional shapes and yet carry out their intended function. Moreover it has been found desirable to vary the shape or dimension of the inserts at different points along the length thereof. For example, plywood sheets or the like might be used to extend the void along the entire width of the weakened plane. The principal purpose in such variances is to change the external ornamental appearance of the wall panel.

It is also possible to use a more ornamental aggregate or cementitious material adjacent the inserts to enhance the ornamental appearance of the panel. Also the form may, of course, be designed to have the grooves G run sidewise rather than lengthwise of the building panel if desired.

While the form is here shown as being disposed on a horizontal plane, it could also be disposed vertically or in a slanted position where such a position is deemed more desirable for the use thereof. It will also be understood that prestressed rods or post tensioning passageways may be disposed perpendicular to each other in a grid-like arrangement on both sides of the weakening plane *x—x*. This is to give added strength to the panels themselves.

Other additions or modifications in the form which are not shown here but which are believed to be conventional in form design are the incorporation of heat curing capabilities, selfleveling devices and means for providing areas within the panel for adding insulation materials. The form may, of course, be designed for use on or off the building site at which the panels are to be used.

I claim:

1. In a form for making concrete building panels, (a) a flat generally rectangular bottom wall, (b) two upright opposing pairs of side walls with one side wall extending along each side of the bottom wall, (c) a top wall lying on a plane parallel to the bottom wall and connecting the upper edges of the side walls to form a boxlike enclosed form for holding concrete, (d) a plurality of elongated insert members extending between one pair of side walls and spaced in parallelism along a common plane midway between the top and bottom walls and extending transversely from adjacent one to adjacent the other of the other pair of side walls, (e) a first set of prestressed rods extending between one pair of side walls intermediate the insert members and the bottom wall, (f) a second set of prestressed rods extending between the other pair of side walls intermediate the insert members and the top wall, (g) each of said sets of rods lying in planes parallel to said common plane, and (h) said first and second sets of rods extending perpendicular to each other.

2. In a form for making concrete bulding wall panels, said form having a relatively shallow broad boxlike configuration with top and bottom walls and parallel side walls and parallel end walls, (a) a plurality of elongated insert members extending in parallelism midway between the top and bottom walls but parallel thereto and uniformly within said side and end walls to form a weakened plane medially through a concrete block poured into and hardened in the form, and (b) stress means in the form for applying compacting pressures to the hardened block in different directions above and below the weakened plane to cause the block to fracture along said plane.

* * * * *